United States Patent [19]

Jacobs et al.

[11] 4,175,457

[45] Nov. 27, 1979

[54] BINDING HOLE PUNCH APPARATUS

[76] Inventors: Morris L. Jacobs, 524 W. Somerset Dr., Indianapolis, Ind. 46260; Hiram J. Dunagan, Moral Rd., Fairland, Ind. 46126

[21] Appl. No.: 894,539

[22] Filed: Apr. 7, 1978

[51] Int. Cl.[2] ..... B26D 5/22

[52] U.S. Cl. ..... 83/230; 83/261; 83/269

[58] Field of Search ..... 83/225, 230, 261, 262, 83/269, 559, 560, 701, 928

[56] References Cited

U.S. PATENT DOCUMENTS

| | | | |
|---|---|---|---|
| 1,746,032 | 2/1930 | Ely | 83/225 |
| 1,761,906 | 6/1930 | Davy et al. | 83/230 |
| 1,796,417 | 3/1931 | Wittek | 83/230 |
| 2,339,962 | 1/1944 | St. Louis | 83/225 |
| 2,874,775 | 2/1959 | Müller | 83/269 X |
| 3,234,840 | 2/1966 | Smeets | 83/559 |
| 3,921,486 | 11/1975 | Valente | 83/559 X |
| 3,931,751 | 1/1976 | Simonson | 83/701 X |

*Primary Examiner*—Frank T. Yost

*Attorney, Agent, or Firm*—Woodard, Weikart, Emhardt & Naughton

[57] ABSTRACT

Disclosed is an apparatus for punching spaced binding holes in discrete stacks of bound pages, the apparatus being characterized by a front stop member and a conveyor belt releasing member whose motion is synchronized with the punch strokes. This action together with use of a joined punch and die assembly in the apparatus adapt the resulting structure for rapid, accurate punching of binding holes in pages received in discrete stacks from a high speed automatic stitcher-binder or the like.

1 Claim, 7 Drawing Figures

BINDING HOLE PUNCH APPARATUS

BACKGROUND OF THE INVENTION

Much bound, printed material such as technical manuals, catalogs, price lists and the like are issued in loose-leaf form or bound form and thus, in addition to trimming and binding, require accurately placed binding holes along one marginal area. Heretofore, this requirement has been fulfilled by utilizing a manually operated drilling station for drilling the required holes, the station being set up separate from the primary flow of the output of binding machinery such as a conventional stitcher-binder. The prior art drilling apparatus was not integrated into the production line output of the binding machinery and thus added an appreciable increment to the time for job completion and to the labor cost of the completed job.

The apparatus of the present invention automatically positions and punches the bound stacks of pages as they are sequentially completed by the binding apparatus. Since it is mounted on rolling casters the punching apparatus can easily be placed in or taken out of the flow of bound material from the printing, trimming and binding apparatus. The use of a front stop or abutment for sequentially positioning the bound stacks to be punched and use of a member for immobilizing the conveyor feed during the punching stroke, the movement of the abutment and of the belt feed control member being synchronized with the punching stroke enables the apparatus to accommodate the output of relatively rapid, automatic stitcher-binder machinery. Use of a simplified joined punch and die assembly in the apparatus eliminates set-up errors and adds to the ability of the apparatus to accurately perform the punching operation in rapidly moving production lines.

DESCRIPTION OF THE PREFERRED EMBODIMENT

Figure 1:
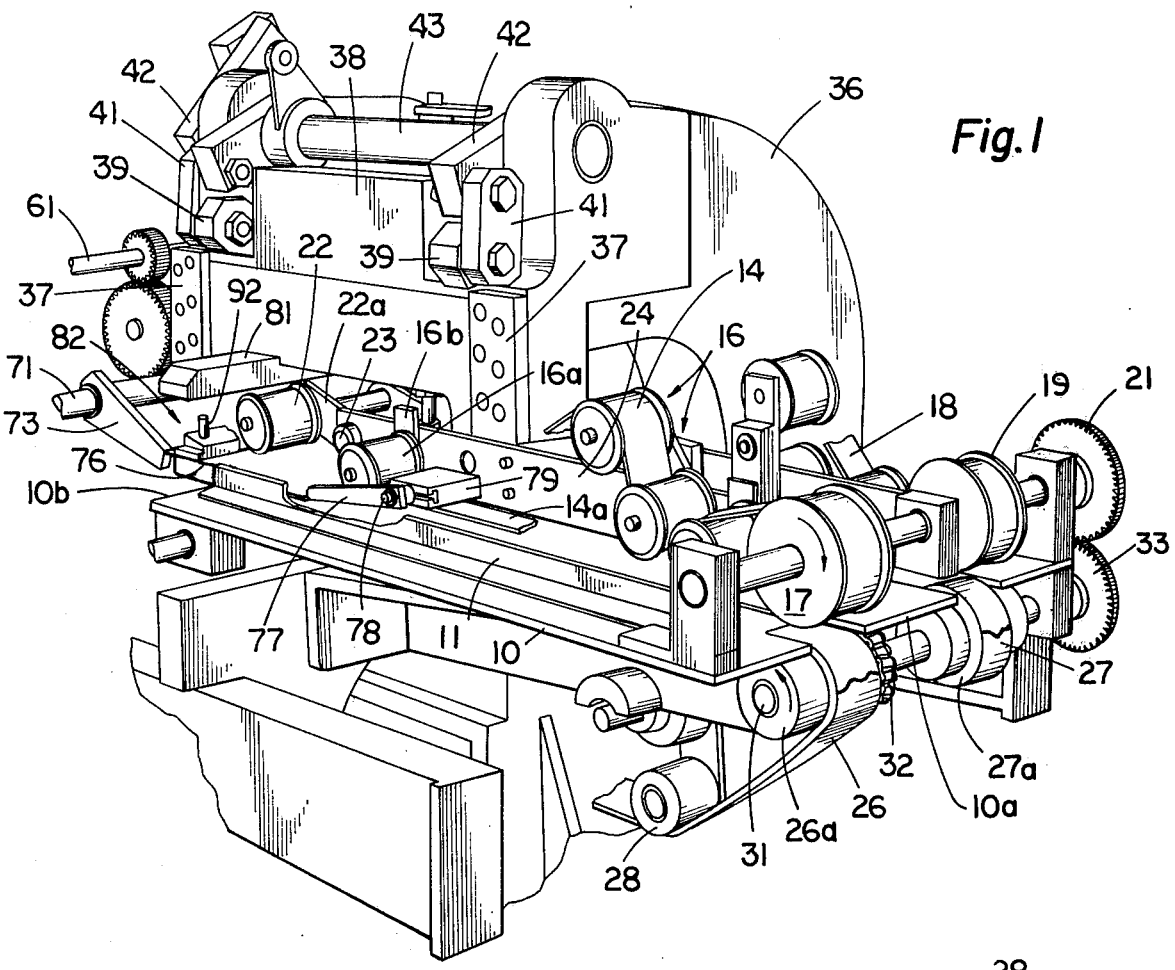
FIG. 1 is a fragmentary perspective view showing the apparatus of the present invention.
Figure 2:
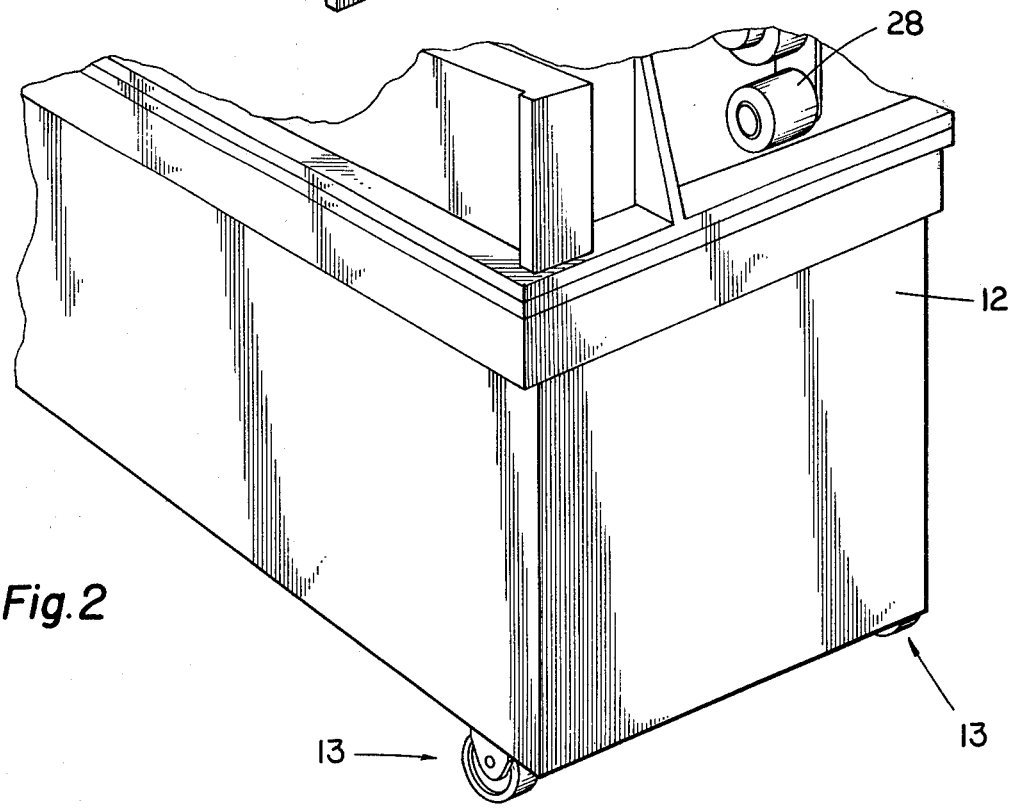
FIG. 2 is a fragmentary, perspective view showing the lower portion of the apparatus shown in FIG. 1.

Referring initially to FIG. 1, the apparatus for punching spaced binding holes may be seen to include a generally horizontal table 10 having spaced guide members or rails 11 extending from its upper surface. The lower portion of the supporting structure, generally indicated at 12, as may be seen in FIG. 2, is provided with swival casters or rollers 13, permitting the apparatus to be conveniently positioned in a production line so that it may receive discrete stacks of bound pages, arriving at relatively high speed from, for example, an automatic stitcher-binder, the end of the table indicated at 10*a* in FIG. 1 being the input or receiving end of the apparatus. The discrete stacks of bound pages (one of which is shown at 76 in FIG. 1) arrive at relatively high speed from the stitcher-binder apparatus and are deposited at the end 10*a* of the table with the edge or marginal area which is to carry the binding holes leading.

A powered conveyor belt 14 moves over the idler rollers indicated at 16 and over a drive roller 17. An identical conveyor belt 18 moves over identical rollers and is driven by the drive roller 19, rollers 17 and 19 being mounted on the same shaft, which is driven through gear 21. The belt 14 (and its twin 18) move over the movably mounted control element embodied by the roller 22. The journalling pin for the roller 22 extends horizontally from the free end of an arm 22*a* which is rigidly secured to, and extends radially from a transverse, horizontal shaft 23. Rotation of the shaft 23 clockwise, as viewed in FIG. 1, thus serves to raise the roller 22, the roller lowering when the shaft 23 is moved counterclockwise as viewed in FIG. 1. The belt 14 leaves the underside of the roller 22 and passes across the underside of the idler roller 16*a* which is mounted so as to be vertically adjustable along the bar 16*b* extending upwardly from the horizontal support member 24 which also serves to support the idler rollers 16. In FIG. 1, the return or lower pass of the belt 14 is indicated at 14*a* and rotation of the drive roller 17 is such that the lower pass 14*a* of the belt moves from the margin 10*a* of the table 10 toward the opposite or discharge end of the table indicated at 10*b*. The belt is shown only fragmentarily in FIG. 1 and is omitted from FIG. 4 so that the adjoining apparatus will not be obscured.

Figure 3:
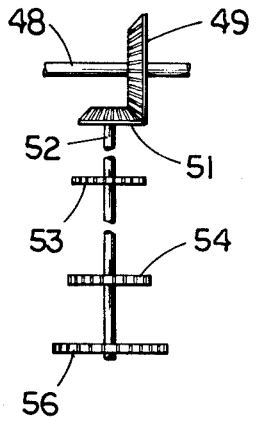
FIG. 3 is a top plan, schematic view of the power transmission portion of the apparatus.

Each of the endless belts 14 and 18 have a corresponding, adjacent endless belts 26 and 27 which pass over rollers 26*a* and 27. The belt 26 (and its twin 27) pass beneath idler rollers 28, around front rollers 29 (FIG. 4) and return along the upper surface of the table 10 and parallel with and below the belt pass 14*a*. The rollers 26*a* and 27*a* are mounted on the shaft 31 which is driven by the sprocket and chain 32 from a drive source which will subsequently be referred to with reference to FIG. 3. The shaft 31 carries the gear 33 which meshes with gear 21 so that all four belts are uniformly driven from the power sprocket 32.

It will be evident that incoming stacks of bound pages are received in the space between upper belt 14–18 and the lower belts 26–27 and the moving belt surfaces serve to transport the stacked pages along the table 10 and toward its discharge margin 10*b*.

Figure 4:
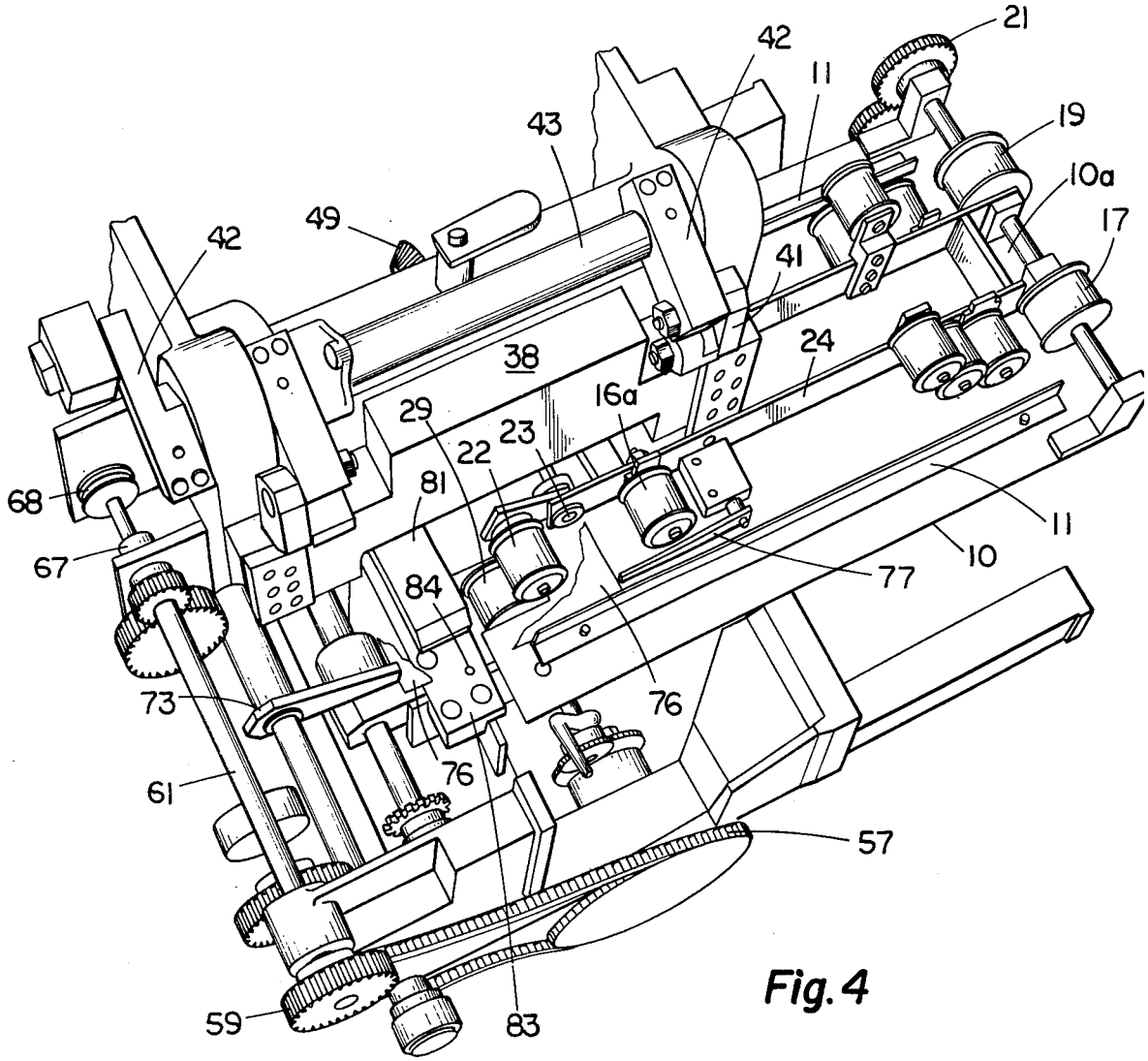
FIG. 4 is a perspective view taken from generally above the apparatus shown in FIG. 1.
Figure 5:
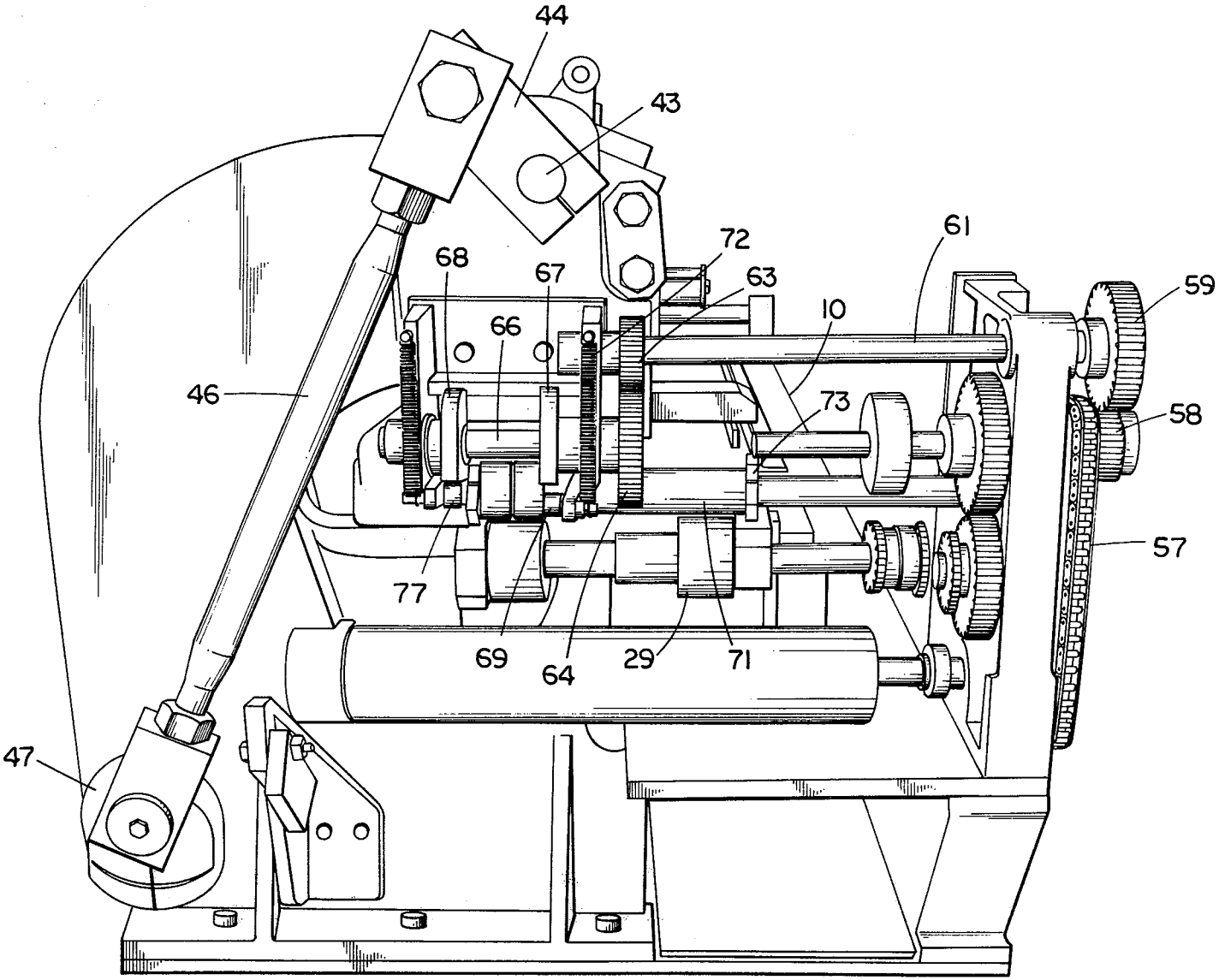
FIG. 5 is an end view of the apparatus shown in FIG. 1.

A generally L-shaped structure, indicated at 36, extends upwardly and overhanges the table 10 and supports vertical guide members 37. Moveable in a vertical reciprocating path determined by cooperation of its end margins with the guide members 37 is a carriage or block 38. Extending tabs 39 on the block are pivotally connected to the lower ends of connecting links 41 whose upper ends are pivotally connected to sidewardly extending arms 42. The arms 42 are angularly rocked, so as to provide the vertical reciprocating motion of the block 38, by means of the shaft 43 which, as may best be seen in FIG. 5, is rigidly attached to the link or arm 44 whose free end is pivotally attached to the upper end of the connecting rod 46. The lower end of the rod 46 is secured to the eccentric member 47. The member 47 is rotated by the shaft 48 (not visible in FIG. 5, but shown in FIG. 3). As may be seen in FIG. 3 the shaft 48 carries a bevel gear 49 (visible also in FIG. 4) which meshes with the bevel gear 51 carried on the main shaft 52 which extends transversely across the structure and beneath the table 10.

The shaft 52 further carries a sprocket 53 (FIG. 3) which, by means of a suitable chain, drives the sprocket 32 providing the motive force for the belts as previously mentioned with reference to FIG. 1. A sprocket 54 is connected by means of a chain (not shown) to a driving means such as an electric motor and gearbox transmission (not shown) which may be located beneath the apparatus described, making the apparatus self-powered, or the chain may provide the driving connection from a power take-off on the stitcher-binder with which the apparatus is used. A sprocket 56 (FIG. 3) by means of chain 57 (FIG. 4) drives a gear 58 which meshes with a gear 59 driving a shaft 61 (FIG. 5) which provides motion for the moveably mounted control member 22, previously described, and a stop member to be subsequently described.

As may be seen in FIG. 5, a shaft 61, through gears 63 and 64, rotates a shaft 66 on which are mounted single lobed cams 67 and 68. The lobe on cam 67 cooperates with a roller or cam-follower 69. Movement of the follower 69 serves to rock the shaft 71 from which the follower extends, the follower being urged against the cam by means of the tension spring 72.

The shaft 71 supports a radially extending stop member 73 which can best be seen in FIG. 1. In FIG. 1, a single bound stack of pages is fragmentarily shown at 76, the stack being shown in forward position, that is, the position in which its spaced binding holes will be punched. The free end of stop member 73, when in lowered position, engages and defines the leading margin of the stack of bound pages. When the shaft 71 is rocked by the cam 67, the tip of the stop member 73 will be raised, permitting the page stack, to proceed off the discharge end **10*b*** of the table.

The cam 68 (FIG. 5) actuates a follower 77 which, when moved by the cam, rocks or angularly moves the shaft 23 to raise momentarily the roller 22 (FIG. 1) thereby lifting the belt 14 from pinching engagement with the upper surface of the stack of bound pages 76 as the stop 73 halts the leading stack. The stack of bound pages to be punched identified at 76 in FIG. 1) is thus positioned by the stop member 73 and immobilized by the lifting of the roller 22 which removes its pinching effect against the lower belt 26. As the punching operation is completed, the roller 22 is dropped into pinching engagement with the upper face of the stack of bound pages and the stop 73 is lifted to permit the punched stack to move off the discharge end **10*b* of the table under the motive force provided by the upper and lower belts. Any reverse or rearward motion of the stack is prevented by the rear stop which takes the form of the arm 77 which is pivotally attached at 78 to the supporting block 79. It will be noted that the attachment 78 for the arm 77 is adjustably moveable with respect to the supporting block 79 to permit positional adjustment of the member 77. Because the member 77 is freely pivoted at 78, stacks of bound pages may successively move beneath the arm, however, any backward or reverse motion of the stack is prevented by the interposition of the tip of the arm 77** against the trailing margin of the page stack.

Figure 6:
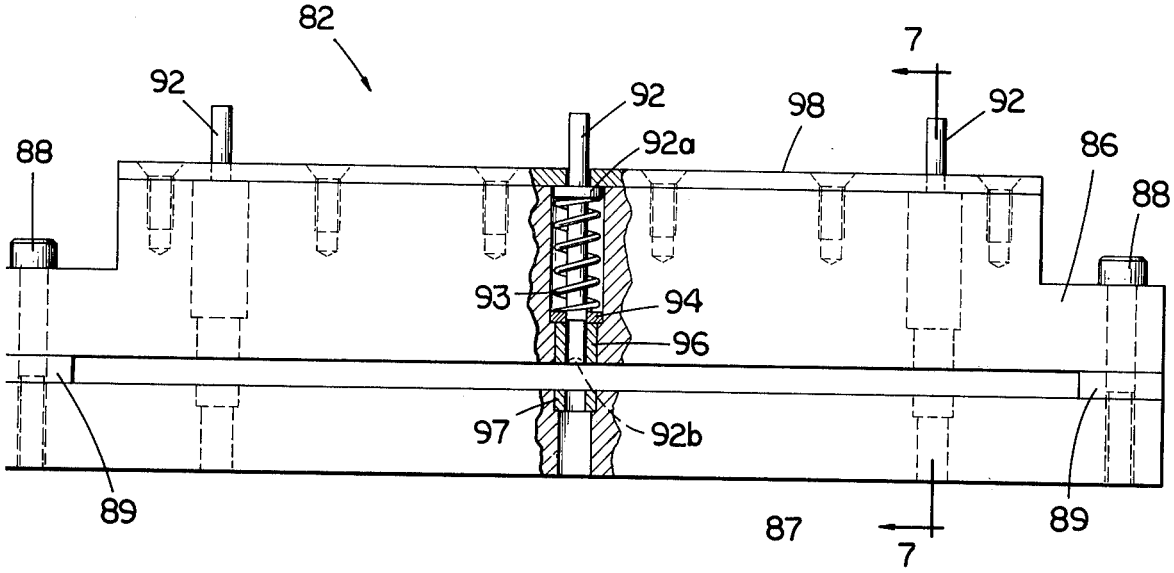
FIG. 6 is a side view, partially in section, of the unitary die and punch assembly incorporated into the apparatus.
Figure 7:
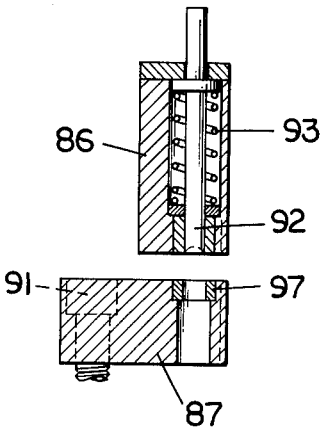
FIG. 7 is a side sectional view taken generally along the line 7—7 of FIG. 6.

Referring now principally to FIGS. 1, 6 and 7, the joined punch and die assembly utilized for performing the specific punching operation will be described. As may best be seen in FIG. 1, the reciprocating block 38 has rigidly attached to it a horizontally extending punch bar 81. Directly beneath the punch bar 81 is mounted the joined punch and die assembly indicated fragmentarily at 82 in FIG. 1 and shown in detail in FIGS. 6 and 7. As may best be seen in FIG. 4, the punch and die assembly 82 is mounted on a punch support plate 83, the plate 83 having threaded holes 84 receiving mounting screws to be referred to with reference to FIGS. 6 and 7. While the bar 81 is shown in FIG. 4, the underlying punch and die assembly 82 is omitted so that the punch support plate 83 will be visible. The joined punch and die assembly 82 includes a punch member or holder 86 and a substantially coextensive die member or die block 87. The members 86 and 87 are fastened in stacked, spaced relation with respect to each other by means of screws 88, the spacing being determined by spacers 89. As may best be seen in FIG. 7, the member 87 is provided with apertures which receive socket head screws 91, the apertures registering with the apertures 84 in the punch support plate 83 (FIG. 4), the screws 91 being threaded into apertures 84 to secure the assembly to plate 83 (FIG. 4). The punch and die members are provided with registering, punch pin-receiving apertures. Punch pins 92 extend through the apertures in the die member 86 and protrude freely through registering apertures in a top plate 98 rigidly secured to the member 86. The pins are provided with an annular shoulder **92*a* which slides freely within an enlarged portion of the through-aperture or bore. A compression spring 93 bears against the underside of each of the pin shoulders and bottoms against a stationary insert 94, the springs 93 encircling each of the pins 92 and serving to urge the pins into their extreme upward or deactuated position defined by engagement of the shoulder 92*a* with the underface of the plate 98. A tubular insert 96 freely receives the lower portion of each of the punch pins, the tip of the punch pins having a concave configuration as illustrated at 92*b*. A tubular insert 97, in the registering apertures in the block 87, receives the lower end portion of the adjacent punch pin as it moves downwardly, the scrap slugs resulting from the punching operation falling through the somewhat enlarged portion of the aperture below the insert 97. The upper ends of the punch pins 92 are adapted to be engaged by, and be moved downwardly by, the descending punch bar 81 as the block 38 moves through its stroke. With the stack of bound pages interposed in the space between the members 86 and 87, as defined by the spacers 89, driving of the pins 92 downwardly by the punch bar 81 punches out the desired binding holes. It will be understood that for stacks of differing thickness, differing spacers 89 may be utilized and that while a three binder hole punch and die assembly is shown in FIGS. 6 and 7**, punch and die assemblies having more or less punching pins may be provided for use in the apparatus.

In operation, with stacks of bound pages being fed one-by-one between the upper and lower belts at the margin **10*a* of table 10, the stacks will be carried by the belts into the position illustrated by stack 76 in FIG. 1. In synchronization, as each stack reaches the stop member 73 and the punch bar 81 starts downward, the roller 22 will be raised halting the forward motion applied by the belt to the stack, and the punch bar 81 will descend to sharply depress the punch pins 92, punching the spaced binding holes in the leading marginal area of the stack of bound pages. As the punch bar ascends, the punch pins will move from their actuated position into their raised, deactuated position and stop member 73 will be rocked upwardly to release the stack 76. Roller 22 simultaneously, will be lowered to permit the belts to give the punched stack the forward impetus required to move it off the margin 10***b* of the table and to move the next stack into position to receive the next punching stroke. It will be understood that the punched stacks leaving the apparatus may be fed to a conventional stacker-counter or to a further belt conveyor for transport to storing bins or to additional operations. The feed of bound stacks to the marginal area 10*a* of the table may proceed from a feeding hopper or, as previously mentioned, from a conveyor belt leading from a conventional stitcher-binder. The use of a joined die and punch assembly minimizes any possible errors in die assembly and eliminates the need for guide pins, bushings and strippers. The apparatus may be self-powered or may be powered from a power take-off on the machinery with which it is operated.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. An apparatus for punching spaced binding holes in discrete stacks of bound pages arriving at relatively high speed from an automatic stitcher-binder or the like, said apparatus comprising a table supported in a generally horizontal plane adapted to receive the bound page stacks at one end margin of the table and to discharge the stacks at its opposite end margin, a powered conveyor belt moved parallel to the surface of said table for moving the bound page stacks in end-to-end relation between said receiving and discharge margins of the table, a unitary die and punch assembly removably mounted adjacent said discharge margin of said table and adapted to receive one-by-one between its die and punch components the bound page stacks moving from said table, a punch bar supported for rectilinear vertical reciprocation between a lowered position in which it actuates said die and punch assembly to punch spaced holes in the bound page stack accommodated in the punch and die assembly and a raised position deactuating said die and punch assembly to permit the punched stack to move off said table and completely through said punch and die assembly, power means for moving said punch bar between its said positions, a stop member mounted for arcuate movement on a first shaft (71) for defining when in operative position the position of the leading margin of the accommodated page stack as said die and punch assembly is actuated, a pinch roller mounted for pivotal movement on a second shaft (23) for maintaining said accommodated page stack in driving engagement with said conveyor belt, and cam means operated in synchronism with the motion of said punch bar for incrementally rotating said first shaft and said stop member out of operative position as said punch bar ascends and for incrementally rotating said second shaft and said pinch roller out of belt engaging position as said punch bar descends, said cam means comprising a third shaft (66) carrying a first cam (67) and a second cam (68) each independently mounted on said third shaft in spaced relation to each other, said first cam cooperating with said first shaft and said second cam cooperating with said second shaft to provide said incremental motion of the shafts, and power means for rotating said third shaft.

* * * * *